United States Patent [19]

Hedderick et al.

[11] Patent Number: 5,029,733

[45] Date of Patent: Jul. 9, 1991

[54] BEVERAGE DISPENSING SYSTEM

[75] Inventors: John B. Hedderick, Pinner; Brian R. Rutty, Addlestone, both of Great Britain

[73] Assignee: Guinness Brewing Worldwide Limited, London, England

[21] Appl. No.: 262,215

[22] Filed: Oct. 21, 1988

Related U.S. Application Data

[63] Continuation of Ser. No. 133,217, Dec. 14, 1987, abandoned, which is a continuation of Ser. No. 838,624, Mar. 11, 1986, abandoned.

[51] Int. Cl.[5] ..... B65D 35/54

[52] U.S. Cl. ..... 222/96; 222/190; 222/129.1; 239/412; 239/432; 239/211; 137/170.1; 261/DIG. 7; 261/28; 261/123

[58] Field of Search ..... 222/190, 135, 145, 129.1, 222/129.2, 105, 96; 239/343, 412, 432, 211; 137/170.1, 170.4, 170.5; 261/DIG. 7, 64.2, 28, 123

[56] References Cited

U.S. PATENT DOCUMENTS 3,349,965 10/1967 Krugger ..... 222/105
3,361,161 1/1968 Schwartz ..... 222/145
3,618,856 11/1971 Sachnik ..... 239/343
4,375,864 3/1983 Savage ..... 222/105

FOREIGN PATENT DOCUMENTS 1063753 3/1967 United Kingdom .

*Primary Examiner*—H. Grant Skaggs

[57] ABSTRACT

A beverage dispensing system and distributing process with such a system has a flexible bag 1 containing the beverage which may have carbon dioxide dissolved therein. The beverage is drawn off through a pipe 3 (assisted by a pump 8) for dispensing through nozzle 5 having a tap 6. Carbon dioxide, nitrogen (or other inert gas) and/or air gases are introduced into the beverage through a passage 11 by way of a fixed orifice restrictor 12 and a non-return valve 13. The pressure of the gas which is introduced is adjustable at 14 and baffles 15 can provide turbulence in the beverage during dispensing to promote the dissolution of the introduced gas therein.

The facility to introduce the gas or gases permits the beverage in the bag 1 to have a low content of carbon dioxide so that the bag collapses under atmospheric pressure while the beverage as dispensed is additionally gasified for the formation of a froth or head.

15 Claims, 1 Drawing Sheet

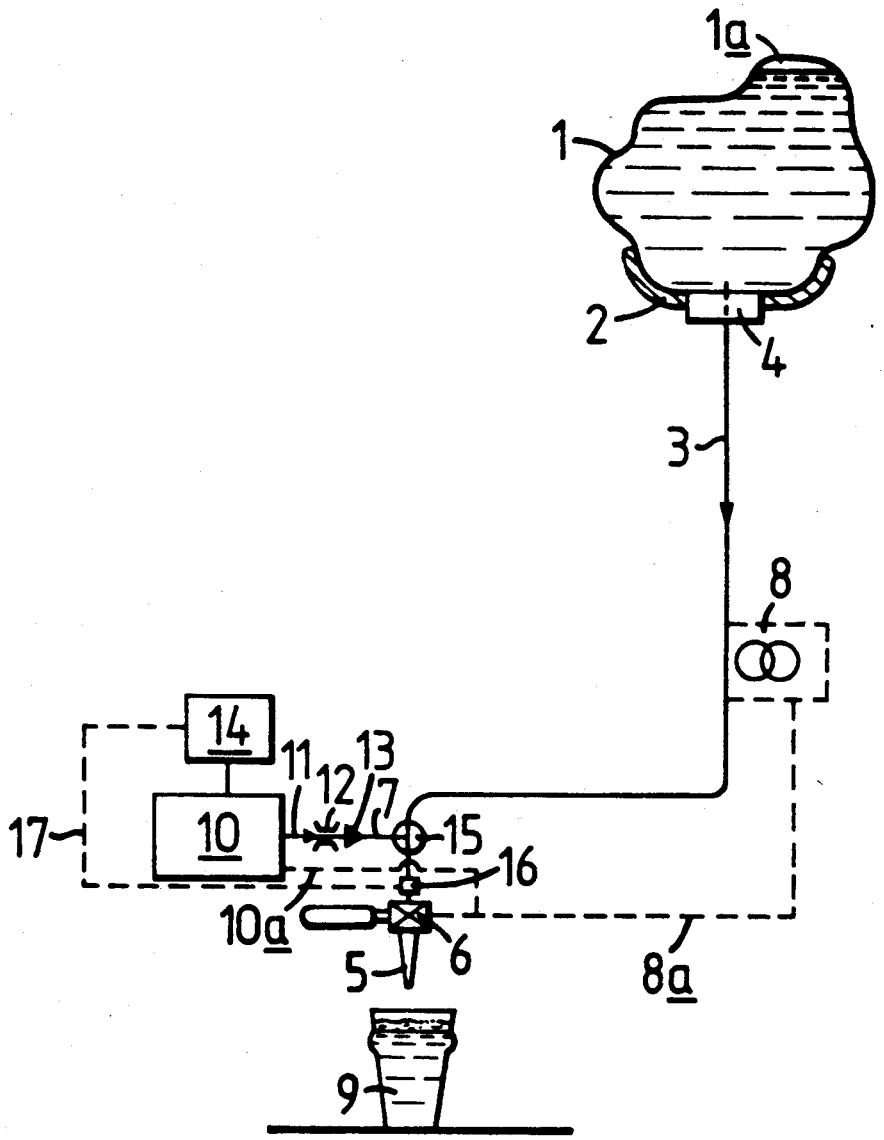
1a
1
2
4
3
8
14
11
12
13
7
10
17
15
16
10a
6
5
8a
9

BEVERAGE DISPENSING SYSTEM

This is a continuation of co-pending application Ser. No. 133,217 filed on Dec. 14, 1987 which is a continuation of Ser. No. 838,624 filed on Mar. 11, 1986 both abandoned.

TECHNICAL FIELD AND BACKGROUND ART

This invention relates to a beverage dispensing system and a beverage distributing process which includes such a system. More particularly, the invention concerns such a process and system which incorporates a flexible container charged with the beverage and which serves as a storage and transport facility and also as a source from which the beverage is withdrawn on demand. Beverage dispensing systems are well known in which a flexible container is charged with a wine, soft drink, beer or cider and fitted with a tap so that as the beverage is drawn off by gravity or pump and on demand through the tap, the container collapses under atmospheric pressure to maintain the beverage remaining therein substantially without headspace. It is appreciated that containers for the aforementioned systems are formed with a flexible wall structure which is impervious to the contents, precludes the beverage from the external atmosphere and has negligible, if any, adverse effect upon the characteristics of the beverage. Generally the flexible wall structure is of plastics sheeting or metal foil or laminations thereof. A problem encountered with known dispensing systems as aforementioned is that the beverage when dispensed has little or no gas content (either dissolved therein or liberated in the form of a froth or head on the dispensed beverage) so that the beverage as dispensed is usually regarded as "flat". For many beverages such as beer, lager, stout, cider, wine and soft drinks there is a preference by the majority of consumers that the beverage when dispensed should contain a recognisable proportion of gas, conventionally carbon dioxide. The usual consumer preference is that the beverages as aforementioned should have more than one volume of carbon dioxide gas (as measured at 1 atmosphere and 0° C.) dissolved therein for each volume of the beverage and which gas may be retained in the beverage by a pressure on the flexible container of 1 atmosphere. Whilst it is possible to charge the flexible container with beverage having carbon dioxide gas dissolved therein and to an extent much greater than, say, one volume of carbon dioxide gas per volume of beverage, it is found that during transport and storage of the container with the highly gasified beverage at ambient temperature, say 16° C. or greater, the carbon dioxide gas is liberated and tends to inflate the flexible container so as to achieve an equilibrium condition in which the partial pressure of dissolved carbon dioxide gas is 1 atmosphere. This inflation will be maintained as the beverage is withdrawn from the container and the consequence is that the beverage as dispensed from a flexible container stored at atmospheric pressure will contain no greater volume of carbon dioxide than is achieved by equilibrium with a partial pressure of 1 atmosphere of carbon dioxide. It is well known physical law that the volume of carbon dioxide gas which can be dissolved in a given volume of beverage will increase as the partial pressure of carbon dioxide which is applied to the beverage increases and decreases as the temperature of the beverage increases; bearing in mind that the flexible container is to be subjected to atmospheric pressure, it can be determined from readily available tables that at 15° C. approximately one volume only of carbon dioxide gas can be dissolved in one volume of beverage. Since it frequently occurs that a beverage may be dispensed from a flexible container in a known system as aforementioned and at a temperature in excess of 15° C. It will be appreciated for the reasons previously discussed, that it is difficult to provide more than say one volume of carbon dioxide gas per volume of beverage in the beverage dispensed from said container. Even if the beverage within the container has dissolved therein one volume of carbon dioxide gas per volume of beverage, it will be apparent that this is far less than consumer preference and it is for this reason that known beverage dispensing systems of the kind previously discussed are primarily used for beverages which are acceptable to the consumer in a relatively un-gasified or flat condition. Flexible containers of the kind mentioned above are a convenient and economical means for the storage and transportation of beverage and there is a requirement for a beverage dispensing system and distributing process which includes a flexible container of the beverage that is collapsible under atmospheric pressure during dispensing of the beverage and from which the beverage can be dispensed having gas dissolved therein to an extent greater than that available with existing flexible container dispensing systems and without changing the characteristics of the beverage as it is progressively dispensed from the container—it is an object of the present invention to satisfy this requirement.

STATEMENT OF INVENTION AND ADVANTAGES

According to the present invention there is provided a beverage dispensing system which comprises a flexible container of the beverage, said container being subjected externally to atmospheric pressure and sealing the beverage therein from the external atmosphere; dispensing means in sealed communication with the beverage in the container for dispensing beverage from the container while the container collapses under atmospheric pressure to maintain the beverage remaining therein substantially without headspace; and means for introducing into the beverage remotely from the container and during said dispensing, at least one of carbon dioxide, nitrogen (or other inert gas) and air gases so that said introduced gas or gases serves to provide or increase a dissolved gas content of the beverage and to form or assist in the formation of a froth or head on the beverage as dispensed.

By "inert gas" as used throughout this Specification is meant a gas other than carbon dioxide with the following properties (i) it does not itself react chemically with the beverage;

(ii) when applied to, or dissolved in, the beverage it does not promote or develop bacteriological reactions;

(iii) it is not harmful to the consumer;

(iv) it does not impair the normal taste of the beverage. Accordingly nitrogen may be regarded as an inert gas; an example of another inert gas which may be considered suitable for the purpose of the present invention is argon.

The system of the present invention will be located at a place of dispense for the beverage to which the flexible container of the beverage will be delivered in a sealed condition so that it will be a simple matter to pierce or break the seal and couple the container into the system. The beverage within the flexible container may, for practical purposes, be considered as devoid of gas (especially carbon dioxide) dissolved therein so that the entire dissolved gas content may be introduced into the beverage during its dispensing from the flexible container. Alternatively however the beverage within the flexible container may have carbon dioxide gas dissolved therein. If present, this gas is preferably at least 0.6 volumes and less than 1.5 volumes of $CO_2$ per volume of beverage. Typically the beverage will have approximately 1.0 volumes of $CO_2$ per volume of beverage since, at the place of dispense, it is likely that the flexible container will be stored for dispensing at a temperature less than 15° C. (so that the carbon dioxide is unlikely to be liberated at atmospheric pressure) and consequently proportionally less gas need be introduced during the dispensing. With fermented beverages such as beer, lager, stout and cider, the carbon dioxide dissolved in the beverage in the flexible container may result from the fermentation process. With the aforegoing in mind, there is further provided a beverage distributing process which comprises charging a flexible container with the beverage, said beverage upon charging being at atmospheric pressure and having carbon dioxide dissolved therein in the range of 0.6 to 1.5 volumes per volume of the beverage; sealing the charged container; breaking said seal and coupling the container in the dispensing system as previously specified as being in accordance with the present invention and with the beverage communicating with the dispensing means; controlling the flow of beverage from the container for dispensing while said container collapses under atmospheric pressure over the beverage remaining therein to maintain said beverage substantially without headspace and introducing into the beverage during said dispensing and remotely from the container at least one of the carbon dioxide, nitrogen (or other inert gas) and air gases so that said introduced gas or gases serve to increase the dissolved gas content of the beverage and to form or assist in the formation of a froth or head on the beverage as dispensed.

For the majority of beers, lagers, wines, ciders or soft drinks which may be dispensed from the flexible container, the gas which is introduced thereto during the dispensing will usually be carbon dioxide derived from a storage bottle or appropriate local source which may be available on the premises. For some fermented beverages, particularly stout, the gas which is introduced during the dispensing will usually be nitrogen or air (relying upon the high nitrogen content in air)—the nitrogen being derived, say, from an appropriate storage bottle or the air being derived from a compressor upon demand. Although the exposure of a fermented beverage to the oxygen content of air is normally considered detrimental to the beverage over a prolonged period, it will be appreciated that by the present invention the air is only introduced on demand and shortly before the beverage is dispensed and accordingly it has been found that the exposure of the beverage to the atmospheric oxygen has negligible effect upon the desired characteristics of the beverage. Where air or nitrogen gases are introduced to a fermented beverage as aforementioned, it is preferred that the beverage within the flexible container has carbon dioxide gas dissolved therein so that the beverage is dispensed with a mixed carbon dioxide and nitrogen gas content in accordance with the disclosure in our U.K. Patent Specification No. 876,628.

The dispensing means will usually comprise a manually adjustable valve or tap which controls the flow of beverage from the container. It is preferred that the adjustment of this tap also serves to control the introduction of the gas into the beverage during dispensing. The dispensing system may include a pump for withdrawal (or to assist in the withdrawal) of the beverage from the container and the operation of this pump may also be controlled by operation of the aforementioned valve or tap.

The aforementioned control tap or valve will usually have a nozzle extending therefrom through which the beverage is dispensed. Preferably the gas or gases are introduced into the beverage upstream of the control tap or valve, conveniently adjacent to that tap or valve. It is believed important that the volume of gas which is introduced into the beverage during dispensing can be accurately controlled to ensure that the dispensed beverage is not under or over gasified to an unacceptable level from the desired characteristics. With this in mind it is preferred that the gas is introduced into the beverage by way of a fixed orifice and subsequently through a non-return valve which non-return valve ensures that the orifice (which will necessarily be of a relatively small diameter) is not contaminated by the beverage; it is also preferred that the pressure at which the gas is introduced into the fixed orifice is adjustable so that it can be set and maintained at a predetermined level during setting up of the system for a particular beverage and for prevalent temperature and other conditions associated with the system. It is believed that the aforementioned fixed orifice and variable pressure arrangement for introducing the gas or gases to the beverage during dispensing provides an improved means of controlling the volume of the gas which is introduced as compared with an arrangement in which the aforementioned orifice is adjustable whilst the pressure of the gas directed thereto remains substantially constant. It is also preferred that the dispensing system immediately downstream of the position at which the gas or gases are introduced into the beverage includes means, such as baffles, by which the beverage is subjected to turbulence to promote the rate at which the introduced gas or gases are absorbed by the beverage. The dispensing system may also include small apertures or restrictors through which the beverage is dispensed downstream of the position at which the gas or gases are introduced (particularly where the introduced gas is or comprises nitrogen) which small apertures or restrictors subject the beverage to cavitation and assist in liberating the dissolved gases to form or assist in the formation of a froth or head on the dispensed beverage.

The beverage dispensing system may include monitoring means (such as a closed loop control arrangement) whereby the proportion of gas or gases in the beverage (following the introduction of the gas or gases thereto) is continuously monitored during dispensing and adjusted to ensure that the beverage is dispensed with a substantially constant and preset gas content.

DRAWING

One embodiment of a beverage dispensing system constructed and operated in accordance with the present invention will now be described, by way of example only, with reference to the accompanying illustrative drawing which diagrammatically illustrates a relatively simple and inexpensive arrangement for the dispensing of a fermented beverage.

DETAILED DESCRIPTION OF DRAWING

The beverage dispensing system illustrated is primarily intended for dispensing stout from a flexible bag 1 having a plastics sheet/metal foil or other (relatively) impermeable barrier wall structure and which is intended to collapse under atmospheric pressure as the stout is drawn off. The dispensing system forms the end of a stout distribution process which commences, usually at a brewery, with the bag 1 being charged under atmospheric pressure with the stout; typically the bag will be capable of holding say from 3 to 100 liters of stout. The stout which emanates from the brewery will likely have approximately 1 volume of carbon dioxide gas dissolved in it for each volume of stout as a result of the fermentation process, and to ensure that this gas is not liberated, it is preferred that the bag is charged with the stout at a temperature less than, say, 15° C. When fully charged the bag 1 is sealed so that the stout is isolated from atmospheric air and subsequently transported for connection to the dispensing system which will be located at a place of dispense, usually (but not necessarily) a retail outlet.

To facilitate handling during transportation the bag will usually be supported/protected within a rigid or semi-rigid container. During transportation of the bag it is possible that some of the carbon dioxide within the stout may be liberated, for example as a result of the stout being subjected to a relatively high temperature and/or being disturbed—this may result in a small carbon dioxide headspace 1*a* being formed in the bag but this headspace should dissipate as the gas re-dissolves when the bag is left to settle in cool conditions (which usually prevail at a dispensing site).

In the dispensing system the bag 1 may be mounted on or in an appropriate support 2 and its seal broken by coupling to a pipe 3 through which the stout is to be dispensed. The pipe 3 can conveniently be coupled to the bag 1 by providing a tubular probe on the pipe end which breaches a diaphragm or other form of seal 4 on the bag so that the stout is in sealed communication with the pipe 3 and such communication is effected without the admission of air. Preferably the communication between the pipe 3 and the stout is at the lowermost position of the bag 1 so that the stout will flow naturally into the pipe 3. The pipe 3 communicates with an outlet nozzle 5 having a manually operated dispensing control tap 6. Provided in the pipe 3 upstream of the tap 6 is a gas admission inlet 7 through which it is intended that one or more of carbon dioxide, nitrogen (or other inert gas) or air gases may be introduced into the beverage during dispensing. To assist in drawing off the beverage from the bag 1, the pipe 3 can include a pump 8 which may be electrically controlled (as indicated by the line 8*a*) by operation of the tap 6 so that the pump is operated only when the tap is open for dispensing purposes.

In the present example the stout is intended to be dispensed from the tap 6 having a mixture of gases, carbon dioxide and air dissolved in it—these gases serving to provide desirable characteristics to the stout as dispensed and also to form or assist in the formation of a head as the stout is dispensed into an open topped container 9; the use of such mixed gases in the dispensing of fermented beverages is discussed in our British Patent No. 876,628. With this in mind, air having its high content of nitrogen is introduced by way of the inlet 7 into the stout being dispensed and upon demand during dispensing. To achieve this the system includes an air compressor 10 which is operated through a line 10*a* under control of the tap 6 so that air under pressure is directed to the inlet 7 only when the tap 6 is open for dispensing purposes. Air under pressure from the compressor 10 is directed through passage 11 to the inlet 7 by way of a restricted orifice 12 and subsequently by way of a non-return valve 13. The restrictor 12 has a fixed orifice and serves to reduce the air pressure prior to its introduction to the stout. The non-return valve 13 alleviates the possibility of stout flowing from the pipe 3 into and blocking the restrictor 12. Means shown generally at 14 is provided for adjusting the air pressure derived from the compressor 10 and this means provides a convenient way of setting up the system for a particular stout by which it may be ensured that a required flow rate and pressure of air can be introduced into the stout by way of the fixed orifice restrictor 12. In a typical stout dispensing system the air will be introduced to the beverage being dispensed so that approximately 0.002 to 0.1 volumes of nitrogen gas in the air are introduced and dissolved into each volume of stout. To assist in the dissolution of the air along with the carbon dioxide gas in the stout, the pipe 3 can include baffles or other means shown generally at 15 downstream of the inlet 7 to create turbulence in the beverage during its flow to the nozzle 5. It will be noted that the air from the compressor 10 is introduced into the pipe 3 only on demand and immediately upstream of the tap 6 and as a consequence the relatively short period of exposure of the stout to the oxygen in the air has not been found to have any adverse effects upon the characteristics of the stout in a practical system. Where air/nitrogen gas is introduced as aforementioned, the nozzle 5 preferably includes a cavitation or restrictor plate which assists in the liberation of the dissolved gases from the stout and enhances the formation of the froth or head during dispensing in accordance with conventional practice.

It will be realised that in the stout dispensing system as above described, pure nitrogen can be introduced into the beverage by removing the compressor 10 and connecting the passage 11 to a bottle or other source of nitrogen gas under pressure (but again it is preferred that this pressure is adjustable at 14). If the dispensing system is intended for use with a flexible bag 1 containing beverage which is to be dispensed in a highly carbonated condition then the compressor 10 can be removed and the passage 11 coupled to a $CO_2$ ring main or bottle of carbon dioxide under pressure—preferably with the means 14 for adjusting that pressure so that all or a proportion of the carbon dioxide can be introduced into the beverage during dispensing.

If required the system as above described can be provided with means for monitoring the proportion of gas in the beverage as dispensed and for controlling and adjusting, as necessary, the gas which is introduced to the beverage to maintain the beverage as dispensed with a substantially constant and preset gas content. This may be achieved by use of a closed loop control arrangement whereby a detector 16 in the pipe 3 downstream of the gas admission inlet 7 is responsive to the gas content in the beverage and is coupled (as indicated at 17) to the gas pressure adjustment means 14 to cause an adjustment, as necessary, in the gas pressure for increasing or decreasing the proportion of the introduced gas to maintain the gas content as detected at 16 substantially constant at a preset level.

We claim:

1. A beverage dispensing system which comprises a flexible container of the beverage, said container being subjected externally to atmospheric pressure and sealing the beverage therein from the external atmosphere; dispensing means in sealed communication with the beverage in the container for dispensing beverage from the container while the container collapses under atmospheric pressure to maintain the beverage remaining therein substantially without headspace; and means for introducing into the beverage remotely from the container and during said dispensing, at least one of carbon dioxide, nitrogen and air gases so that said introduced gas serves to provide or increase a dissolved gas content of the beverage and to form or assist in the formation of a froth or head on the beverage as dispensed, said introducing means comprising a pressurized source of the gas which is to be introduced, a fixed orifice restrictor and a non-return valve successively through which pressurised gas from the source is introduced into the beverage, and means for adjusting the pressure of the introduced gas prior to said gas passing through the restrictor.

2. A system as claimed in claim 1 in which the beverage within the container has carbon dioxide gas dissolved therein.

3. A system as claimed in claim 2 in which the carbon dioxide gas content dissolved in the beverage in the container is less than 1.5 volumes per volume of the beverage.

4. A system as claimed in claim 1
in which the beverage in the container is maintained substantially without headspace.

5. A system as claimed in claim 1
in which means is provided for subjecting the beverage and the gas or gases introduced thereto to turbulence during the dispensing of the beverage to promote the dissolution of the introduced gas in the beverage.

6. A system as claimed in claim 1
in which the gas or gases are introduced only during dispensing of the beverage.

7. A system as claimed in claim 1
in which the dispensing means comprises a pump for withdrawing beverage from the container on demand.

8. A system as claimed in claim 7 in which the dispensing means comprises a tap or valve which controls the flow of beverage during dispensing and said tap or valve controls at least one of the introduction of the gas or gases and operation of the pump during dispensing of the beverage.

9. A system as claimed in claim 1
in which the gas which is introduced is air and an air compressor is provided for effecting said introduction on demand.

10. A system as claimed in claim 1
in which the gas which is introduced comprises nitrogen, said nitrogen being dissolved in the beverage in the range of 0.002 to 0.100 volumes of nitrogen per volume of beverage.

11. A system as claimed in claim 1 in which the gas which is introduced is carbon dioxide and the carbon dioxide dissolved in the beverage following said introduction is in the range of 1.2 to 4 volumes of carbon dioxide per volume of the beverage.

12. A system as claimed in claim 1
in which the dispensing means comprises a nozzle which includes cavitation means for liberating gas or gases dissolved in the beverage to assist in the formation of said froth or head.

13. A system as claimed in claim 1
and comprising monitoring means whereby the proportion of gas in the beverage following the introduction of gas thereto is continuously monitored during dispensing and adjusted to maintain the beverage as dispensed with a substantially constant and preset gas content.

14. A system as claimed in claim 1
in which the beverage is fermented.

15. A beverage distributing process which comprises charging a flexible container with the beverage, said beverage upon charging being at atmospheric pressure and having carbon dioxide dissolved therein in the range of 0.6 and 1.5 volumes per volume of the beverage; sealing the charged container; breaking said seal and coupling the container in a dispensing system with the beverage communicating with a dispensing means; controlling the flow of beverage from the container for dispensing while said container collapses under atmospheric pressure over the beverage remaining therein to maintain said beverage substantially without headspace; introducing into the beverage during said dispensing by way of a restrictor and a non-return valve and remotely from the container at least one of carbon dioxide, nitrogen and air gases so that said introduced gas or gases serve to increase the dissolved gas content of the beverage and to form or assist in the formation of a froth or head on the beverage as dispensed; and adjusting the pressure of the introduced gas to provide a required head or froth formation.

* * * * *